United States Patent [19]

Gilliams et al.

[11] 4,130,670

[45] Dec. 19, 1978

[54] PROCESS FOR FIXING TONER IMAGES

[75] Inventors: Yvan K. Gilliams, Hever; Walter F. De Winter, 's-Grevenwezel; August J. Van Paesschen, Antwerp; Daniël M. Timmerman, Mortsel, all of Belgium

[73] Assignee: Agfa-Gevaert, N.V., Mortsel, Belgium

[21] Appl. No.: 723,189

[22] Filed: Sep. 14, 1976

[30] Foreign Application Priority Data

Sep. 16, 1975 [GB] United Kingdom ..... 38070/75

[51] Int. Cl.[2] ..... G03G 13/20

[52] U.S. Cl. ..... 427/16; 427/17; 427/19; 427/22; 427/108; 427/198; 427/207 A; 428/353; 428/355

[58] Field of Search ..... 427/14, 16, 17, 22, 427/198, 207 A, 108; 250/315 A; 428/353, 355; 96/1.2, 1.4

[56] References Cited

U.S. PATENT DOCUMENTS

| | | | |
|---|---|---|---|
| 3,774,029 | 11/1973 | Muntz et al. | 250/315 A |
| 3,804,508 | 4/1974 | Mihajlou et al. | 96/1.2 |
| 3,847,642 | 11/1974 | Rhodes | 427/16 |

*Primary Examiner*—Ronald H. Smith
*Assistant Examiner*—Stuart D. Frenkel
*Attorney, Agent, or Firm*—William J. Daniel

[57] ABSTRACT

A sheet or web material for use in developing and fixing toner images which comprises a support and a thermo-adhesive fixing layer defining the surface of the material on which the toner image is deposited. The thermo-adhesive fixing layer comprises an organic polymeric material and has the following properties: a surface resistance above $10^{10}$ Ohm/square, freedom from blocking at least up to 35° C, a melt viscosity at 190° C of not more than 120 P, and an abrasion resistance at 20° C above 175 g.

The process for fixing a toner image on this sheet or web material comprises the steps of image-wise depositing on said thermo-adhesive fixing layer toner particles forming with the molten thermo-adhesive fixing layer a contact angle smaller than 90°, heating above 90° C at least those parts of such layer corresponding with the toner images, said heating being of a sufficient intensity and duration that said particles sink within the softened fixing layer, and allowing said imaged layer to cool to fix said image particles in said layer.

15 Claims, 1 Drawing Figure

PROCESS FOR FIXING TONER IMAGES

Figure 1:
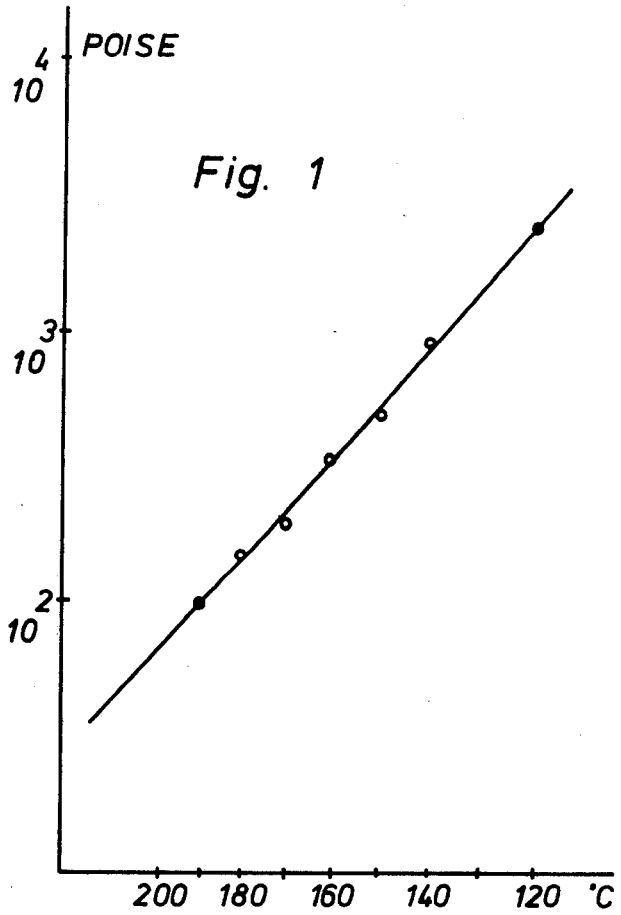

This invention relates to a process for developing and fixing toner images, to materials for forming fixed toner images according to said process and to said materials containing the fixed toner images.

Electrophotography, ionography and electrography are well-known imaging techniques wherein electrostatic charge patterns are made visible with finely divided electostatically attractable material called "toner".

Historically, a one-component dry powder toner was first used for developing electrostatic images. Other development processes, presently known as cascade, fur brush, powder cloud, magnetic brush and liquid electrophoretic development were introduced. A survey and description of the above mentioned imaging and development processes is given e.g. by R. M. SCHAFFERT in Electrophotography, The Focal Press, London and New York (1965). Other development techniquies based on the image-wise deposition of liquid, wetting the recording material in conformity with an electrostatic charge pattern, are described in United Kingdom patent specifications Nos. 987,766 filed Apr. 18, 1962 by Agfa AG, 1,020,503 filed Nov. 8, 1961, 1,020,505 filed Nov. 8, 1961, 1,033,419 and 1,033,420 filed Nov. 26, 1962 all by Gevaert Photo-Producten N.V.

Many of the powdered toners used in xerography consist primarily of fusible resins. When such toners are deposited or transferred to a receptor paper sheet, the toner images can be permanently fixed by heating or by applying a solvent vapour, which partially dissolves the toner and causes it to adhere to the image-receiving materials.

Developers of the electrophoretic type initially comprised basically a simple dispersion of a pigment and no binder was present. It was later proposed, e.g. by METCALFE and WRIGHT, J. Oil Colour Chem. Ass., 39 (1956) pages 851–853, to use liquid developers incorporating resins and control agents. The resultant images are then made of so-called "self-fixing" toners.

Toner images that are formed electrophoretically on paper supports by means of an insulting carrier liquid comprising dispersed toner particles are fixed by adhesion and absorption into said supports and usually do not require additional fixing.

A problem of permanent adherence arises, however, when electrophoretically deposited toner particles have to be adhered to smooth non-porous supports e.g. resings, polymers, metal or glass supports. Even self-fixing toners are still not sufficiently permanently adherent to smooth surfaces and therefore the resultant toner images have to be fixed by a subsequent procedure.

One useful procedure for subsequent fixing of toner images is by the application of a lacquer overcoat. Various procedures have been suggested for applying such a lacquer overcoat. In practice the lacquer is usually applied by spraying a resin solution on the toner image. The spraying technique requires a propellant gas or air under pressure, which makes the apparatus rather sophisticated. In addition thereto the spray nozzle is often clogged when the apparatus is at rest after having been used.

Another mmethod has been to apply the resin solution with an applicator roller. This method has the disadvantage that the resin solution is exposed to the air, which causes drying of the solution.

Further it has been suggested to laminate a transparent sheet over the toner images. When this is carefully done the protection of the image is excellent, but the image is often damaged during the application of the protective sheet and danger always exists that a delamination at the edges of the laminate may occur.

From the United Kingdom patent specification No. 1,149,265 filed May 27, 1966 by Rank Xerox Ltd. a method for fixing photoelectrophoretic toner images on a smooth surface is known in which the particle image is embedded in a thermo-adhesive layer by pressing a sheet carrying the thermo-adhesive layer in a tacky state, onto the image present on a Nesa (trade name) glass electrode. The image can also be fixed by pressing a roller against the toner image on a thermo-adhesive layer in a tacky state.

This fixing method presents likewise disadvantages. In order to obtain a really good fixed image of high density and possessing high abrasion resistance, it is necessary to press the toner particles into the thermo-adhesive layer by means of a roller. It has been practically impossible, without special aids, not to smudge the pressure roller with pigment particles will smudge the images that are produced subsequently.

The problem of fixing toner images on smooth transparent supports arises most frequently in the production of toner-developed electrostatic images produced through radiography, wherein mostly images on smooth, transparent supports are desired.

By the term "radiography" we designate a recording technique that makes use of pentrating radiation, which includes e.g. X-rays, $\gamma$-rays, $\beta$-rays, fast electrons and neutrons capable of effecting ionization in a gas medium absorbing said radiation.

In xeroradiography, such as disclosed in U.S. Pat. No. 2,666,144 of Roland M. Schaffert, Robert C. McMaster and William E. Bixby, issued Jan. 12, 1954, an electrostatic image is formed by exposure of a precharged photoconductive member (e.g. a selenium layer) to an X-ray image thereby producing conductivity in the photoconductor whereby the applied charge leaks off in the exposed areas. The obtained electrostatic charge pattern is developed with toner. A selenium layer does not form a contrasting image background for the toner image so that the toner has to be transferred to a suitable contrasting support, e.g. a smooth transparent resin support on which the toner image is fixed.

A special method of producing electrostatic charge patterns that finds application in X-ray image recording is based on photo-emission of charged particles.

Processes in which the electrostatic image formation is based on photoelectron emission are described e.g. in the U.S. Pat. Nos. 2,221,776 of Chester F. Carlson issued Nov. 19, 1940; 2,692,948 of Kurt S. Lion issued Oct. 26, 1954; 2,900,515 of Edward L. Criscuolo and Donant T. O'Conner issued Aug. 18, 1959; 3,057,997 of Edward K. Kaprelian issued Oct. 9, 1962 and 3,526,767 of Walter Roth and Alex E. Jvirblis issued Sept. 1, 1970, the United Kingdom patent specification No. 778,330 filed Apr. 15, 1955 by Compagnie Francaise Thomson-Houston, the German patent specification No. 1,497,093 filed Nov. 8, 1962 by Siemens AG, and the published German patent applications Nos. 2,231,954 filed June 29, 1972 and 2,233,538 filed July 7, 1972 by Diagnostic Instruments. Except for the processes described in the latter three patents the photoelectron emission proceeds with a solid photocathode.

A particularly interesting radiographic recording technique is known as ionography. In ionography positive and negative charge carriers are formed image-wise between electrodes in an ionizable gas or liquid medium with the aid of image-wise modulated penetrating radiation. One type of said charge carriers is by the influence of the electric field between said electrodes deposited on a dielectric receptor sheet hereby forming an electrostatic charge pattern thereon.

One embodiment of ionography is described by K. H. REISS, Z.Ang.Phys., Vol. 19, Feb. 19, 1965, page 1 (see also German patent specification No. 1,497,093 mentioned hereinbefore, and the published German patent application No. 2,226,130 filed May 29, 1972 by Siemens AG.) Use is made of an arrangement of a pair of electrodes with a potential difference applied between them and a gas filling the gap between the electrodes. A dielectric sheet is mounted on the anode and the cathode is made of, or coated with a heavy electron-absorbing metal, such as lead. A typical gap width or interelectrode spacing is 0.5 mm, with the gas at atmospheric pressure in the gap, giving a gap width-pressure product in the order of 0.5 mm atmosphere. In operation the differentially absorbed X-ray flux incident on the anode traverses the anode (made of a substance transparent to X-rays, such as aluminium or beryllium), traverses the gas with very little attenuation, and impinges on the cathode, which acts as a photoemitter, emitting a current into the gas, the current density emitted at a given area being proportional to the incident X-ray flux density. The gas in the gap acts as a gaseous amplifier, the initial current being amplified by electron multiplication and avalanche in the presence of an acceleration potential difference. In this manner the initial photoelectric emission current from the cathode is magnified considerably by as much as six orders of magnitude or possibly more.

According to another ionographic imaging system described in the U.S. Pat. No. 3,774,029 of Eric P. Muntz, Andrew P. Proudian and Paul B. Scott issued Nov. 20, 1973, the emitting cathode of the Reiss system is omitted as a primary source of electrons and replaced by an X-ray-opaque gas e.g. a gas having an atomic number of at least 36, preferably xenon at superatmospheric pressure, which exhibits a very short stopping distance for the resulting photoelectrons produced therein. During the image-wise X-ray exposure a potential difference is applied between electrodes over the gap comprising said gas and electrons, and positive ions formed in said gas are attracted and moved towards the anode and cathode respectively whereby a charge pattern is formed with one of the types of charged particles on a dielectric receptor sheet.

According to a modified ionographic system described in the U.S. Pat. Spec. No. 3,873,833 of Frank V. Allan, John H. Lewis, Katherina J. Lewis, Arthur L. Morsell, Eric P. Muntz, Paul B. Scott and Murray S. Welkowsky issued Mar. 25, 1975 the above defined X-ray-opaque gas is replaced by an X-ray-opaque and electrically non-conducting liquid.

The charge-receiving sheets used in ionography are preferably smooth non-porous resin films or sheets, which give rise to the above explained problem with regard to toner adherence.

It is an object of the present invention to provide a method for fixing toner images by simple heating, and wherein the use of a pressure roller is not required.

It is a further object of this invention to provide toner receptor materials comprising a support and a thermo-adhesive layer in which the toner image can be fixed at a relatively low fixing temperature, without any need to use pressure and without deformation of the support, and so that the fixed toner image obtained possesses a high abrasion resistance and a good blocking temperature.

Other objects of the invention will become evident from the following description and claims.

According to the present invention a sheet or web material is provided, comprising a film support and a thermo-adhesive fixing layer defining a surface of said material, said layer comprising an organic polymeric material and having a surface resistance (measured as herein defined) above $10^{10}$ Ohm/square, preferably above $10^{13}$ Ohm/square and being free from blocking (as herein defined) at least up to 35° C, the melt of said thermo-adhesive fixing layer possessing a melt viscosity at 190° C of not more than 120 P, preferably not more than 100 P and said thermo-adhesive fixing layer possessing an abrasion resistance (as herein defined) above 175 g at 20° C, preferably above 200 g.

The invention also includes a process for fixing a toner image on a sheet or web material, comprising the steps of image-wise depositing toner particles on a thermo-adhesive fixing layer that itself permanently adheres to a support, to constitute, at least in part, said sheet or web material and heating above 90° C but preferably not above 130° C at least those parts of said thermo-adhesive fixing layer corresponding with the toner image, but without reaching a temperature at which permanent deformation of the sheet or web material occurs, said image being fixed on a thermo-adhesive fixing layer that has a surface resistance (measured as herein defined) above $10^{10}$ Ohm/square, preferably above $10^{13}$ Ohm/square and which is free from blocking (as herein defined) at least up to 35° C, the melt of the thermo-adhesive fixing layer composition forming a contact-angle with the toner particles smaller than 90°, said melt possessing a melt viscosity at 190° C of not more than 120 P and the fixing layer possessing an abrasion resistance (as herein defined) at 20° C above 175 g, preferably above 200 g.

The invention also embraces such a process for fixing a toner image which comprises an electrostatic charge pattern formed through ionography on a receptor material comprising a said electrically insulating thermo-adhesive fixing layer that itself permanently adheres to a support, and developing said electrostatic charge pattern with toner particles, embedding said toner particles in the fixing layer mass by heating above 90° C said layer, wherein melting of the fixing layer takes place without permanent deformation of the support, and wherein said fixing layer is free from blocking (as herein defined) at least up to 35° C, the melt of said fixing layer has a contact-angle (as herein defined) with the deposited toner particles smaller than 90°, said melt has a melt viscosity at 190° C of not more than 120 P, preferably not more than 100 P and the fixing layer posssesses an abrasion resistance (as herein defined) above 175 g.

The surface resistance of the thermo-adhesive fixing layer of a material according to the invention is measured after conditioning the material at a relative humidity of 50%. The surface resistance measurements are performed by means of a pair of electrodes, both electrodes being 0.3 mm thick, have a width of 5 mm and are placed in parallel position at a distance of 10 mm between each other. During the measurements a tension of 85 V is applied between the two electrodes.

The thermo-adhesive fixing layer is to be free from blocking at temperatures at least up to 35° C, as determined by the following "Standard Blocking Test". In this test, two pieces of film material carrying on the film support identical thermo-adhesive fixing layers facing each other are pressed together in vertical position with a pressure of 100 g/sq.cm, whilst being heated to a temperature of 35° C, and if the two film materials do not adhere to each other and easily separate by simple gravity, they are deemed free of blocking.

The abrasion resistance is determined by a "Standard Abrasion Resistance Test" which involves drawing a spherical sapphire needle of 0.076 mm radius over the fixing layer at 20° C while charging or loading the needle with an increasing weight. The abrasion resistance value of this test is the lowest weight at which the sapphire needle leaves a visible scratch on the layer. Depending on the nature of the polymer used in forming the fixing layer and depending also on the nature of possible additives, abrasion resistances above 175 g and preferably higher than 200 g are observed for thermo-adhesive layers giving very good fixing results.

In order that a toner image formed on a sheet or web material according to the invention may have best lasting properties, it is desirable that the toner particles should be embedded in the fixing layer, and accordingly, the melt of such layer should form a contact angle of less than 90° with deposited toner particles. The contact angle depends on the wettability of the toner particles by the molten thermo-adhesive fixing layer composition, and accordingly depends on the composition both of the layer and the toner particles. The smaller the contact angle, the better the wettability will be, a contact angle of 0° defining complete wettability and a contact angle of 180° complete repellency. In fact, for a given fixing layer composition, various toner materials while giving contact angle values of the same order of magnitude will give differing values. The Applicants therefore propose a "standard test" for measuring the contact angle afforded by different fixing layer compositions which resides in the use of the toner material manufactured as follows.

Standard Contact Angle Test

In a ball-mill with a capacity of 140 l filled with 105 kg of steatite balls (diameter : 10 mm, specific gravity : 2.34) the following products were introduced successively :

2.1 kg of 30% solution of NEOCRYL B 702 (trade-name) in ISOPAR G (trade-name)

0.2 l of 5% solution of zinc 2-hexyldecyl sulphonate in isodecane 2.375 kg of PRINTEX G (trade-name)

0.125 kg of HELIOECHTBLAU HG (trade-name)

6 l of isododecane.

NEOCRYL B702 is the trade-name of a copolymer of isobutyl methacrylate and stearyl methacrylate comprising about 0.2% of methacrylic acid, marketed by Polyvinylchemie, The Netherlands. ISOPAR G is the trade-name for an aliphatic hydrocarbon having a boiling range of 160°-175° C and a KB value of 27, marketed by the Esso Standard Oil Company. PRINTEX G is the trade-name of a carbon black pigment marketed by DEGUSSA. HELIOECHTBLAU HG is the trade-name of Bayer A.G. for a copper phthalocyanine, C.I. 74,160.

This mixture was ground at 42 rpm for 15 h and thereupon diluted with isodecane so as to obtain a toner concentrate in 16% by weight concentration.

To measure the contact-angle a uniform layer of the toner particles is formed on a heat-resistant substrate, which is placed in an oven and heated to 120° C. From a pipette a drop of molten thermo-adhesive fixing layer composition, heated to the same temperature, is deposited upon the toner layer. The oven has been associated with an optical bench to make a series of photographs of the deposited drop as a function of time. Upon enlarging these photographs it is possible to determine the contact-angle of the molten material with the layer of toner particles as a function of time. The angle measured at equilibrium is the contact-angle according to this standard test.

In the process according to the invention the toner image is preferably formed by electrophoretically depositing toner particles upon the thermo-adhesive fixing layer. The image is fixed by embedding the toner particles in the molten thermo-adhesive layer. For fast fixing, the toner particles should be easily wetted by the molten thermo-adhesive fixing layer composition, which is attained when the contact-angle of the melt with the toner particles is smaller than 90°.

The use of self-fixing toner materials is not excluded by the present invention. However if such materials are used they must be selected for compatibility with the fixing layer composition, and in this case the contact angle will necessarily be less than 90°.

The melt viscosity of the thermo-adhesive fixing layer depends on the fixing temperature, on the molecular weight of the polymer used in forming the thermo-adhesive fixing layer, on its chemical composition, and on the amount of possible additives present in the fixing layer composition, such as plasticizers. In all our experiments the melt viscosity has been measured by a "standard melt viscosity test" with a DRAGE viscosimeter of Chemisches Institut Dr. A.G. Epprecht, Zurich, Switzerland. In this apparatus the shear stress (expressed in dyne/sq.cm), which depends on the melt viscosity of the polymer, is graphically registered versus the corresponding speed gradient D (expressed in $S^{-1}$), which depends on the angular speed of a rotating spindle in the apparatus and also on the difference in diameter between the spindle and the cup wherein the spindle rotates. The melt viscosities of poly(meth)acrylates, polyesters and of copolymer of styrene and allyl alcohol which, as will be shown further, are to be used preferentially in the process of the invention to form the thermo-adhesive fixing layer, are of Newtonian character at least in the molecular weight ranges suitable for the process of the invention. Accordingly the shear stress $\tau$, which is measured, increases linearly with increasing speed gradient D. Depending on the magnitude of speed gradient D (between 27 $s^{-1}$ and 531 $s^{-1}$) the following relation applies:

$$\eta = \tau / D \text{ (expressed in P)}$$

wherein $\eta$ represents the melt viscosity.

Measuring of the melt viscosity with the DRAGE apparatus according to the test proposed occurs at 190° C. At that temperature the viscosity of the polymer melt is much lower than it would be at the preferred fixing temperature range of 90°-130° C so that the temperatures of the apparatus and of the polymer melt will recover their balance much faster and the measurements can be effected much more rapidly.

As a result of the linear relation between the logarithm of the melt viscosity and the temperature for polymers of suitable chemical composition it is easy to determine the melt viscosity at 90°–130° C by means of a simple diagram. In Example 1 hereinafter the melt viscosity at 190° C of a copolyester of cyclohexane dimethanol and a 80:20 mixture of phthalic acid and terephthalic acid is 98 P, the copolyester having an inherent viscosity of 0,22 dl/g. The diagram presented in FIG. 1 gives for this same copolyester the melt viscosities expressed in P at different temperatures, and from this diagram can be deduced that at the preferred normal fixing temperature of about 120° C the melt viscosity for the above copolyester will be about 2500 P.

The polymers used for forming the thermo-adhesive fixing layer have to possess the desired melt viscosity characteristics.

Indeed, the time required to embed the toner particles in the thermo-adhesive fixing layer and to fix the toner image therein depends on the melt viscosity of the thermo-adhesive fixing layer composition. The fixing time will be shorter as the melt viscosity is lower. This can be achieved by two different procedures.

In order to make a thermo-adhesive fixing layer for performing the invention it is possible to make use of polymers having a range of molecular weights. Low molecular weight polymers may have a suitably low melt viscosity, but as the molecular weight decreases, generally speaking, the abrasion resistance and blocking temperature also decrease. It is accordingly desirable to choose a polymer which affords a suitable compromise between melt viscosity and fixing time on the one hand and abrasion resistance and blocking temperature on the other hand.

However it is also possible to use polymers having a considerably higher molecular weight. In general, these polymers possess higher glass transition temperatures and higher inherent viscosities, so that good abrasion resistances and blocking temperatures of the fixing layers are guaranteed. When these higher molecular weight polymers are used, the melt viscosity of the molten thermo-adhesive fixing layer may be kept below 100 P at 190° C by the addition to the coating layer composition of plasticizers or thermo-solvents. The expression "thermo-solvents" is used to denote substances that are solid at room temperature and that at the fixing temperature are liquid and behave as a solvent or plasticizer for the thermo-adhesive polymer. With these thermo-solvents, even at the low fixing temperature of 90°–130° C, a fixing time of the toner particles of 1 to 20 s can be reached when using higher molecular weight polymers which by themselves would not possess a sufficiently low viscosity to fix the toner particles within that required time. It will be appreciated that a short fixing time is very advantageous.

In the first embodiment described above the thermo-adhesive fixing layer is formed from a thermoplastic organic polymer without the addition of thermo-solvents thereto. In that case, the glass transition temperature (Tg) of the polymer will practically be the same as that of the thermo-adhesive fixing layer, so that the Tg of the polymer has to be at least 35° C to ensure that the blocking temperature of the layer be also at least 35° C. For such a Tg of at least 35° C is needed that the inherent viscosity of the polymer attain a certain minimum value, which for each separate polymer can easily be determined. Moreover, since inherent viscosity and molecular weight are directly bound to each other, this means that in order to have a Tg of at least 35° C, the molecular weight of the polymer be not lower than a certain minimum.

However, when according to the above described second embodiment thermo-solvents are mixed with the thermoplastic organic polymer, the Tg of the thermo-adhesive fixing layer as a whole will be lower than the Tg of the thermoplastic polymer itself, so that the Tg of the polymer is to be higher than 35° C to ensure that the whole fixing layer has a blocking temperature of at least 35° C.

The amount of thermo-solvent may vary between 10 and 50% by weight of the thermo-adhesive polymer. Preferably the amount of thermo-solvent used is kept as low as possible to avoid exudation of the thermo-solvent from the thermo-adhesive layer and to keep the blocking temperature of the fixing layer at an acceptable level of at least 35° C.

Suitable thermo-solvents are e.g.:

chlorinated di- and polyphenyls such as the AROCLOR's (trade-name of Monsanto Chemical Company, St. Louis, Mo., USA)

diphenyl o-phthalate m-terphenyl chloroparaffines cis- and trans-cyclohexanedimethanol benzoate SANTICIZER 1H (trade-name of p-(cyclohexylsulphonyl)-toluene marketed by Monsanto Chemical Company, St.Louis, Mo., USA)

The thickness of the thermo-adhesive layer may vary between 1 and 20 μm, preferably between 3 and 10 μm, depending on the particle diameter of the deposited toner.

Any suitable mixture of binder resins and possibly of thermo-solvents may be used in the toner receptor material of this invention provided the charge-receiving thermo-adhesive fixing layer retains the applied charge for a sufficiently long time to enable the toner development of the charge pattern to take place.

According to a preferred embodiment good results have been obtained by using in the composition of the thermo-adhesive fixing layer linear polyesters resulting from the polycondensation of at least one aromatic dicarboxylic acid, taken from the group consisting of terephthalic acid, isophthalic acid and phthalic acid, optionally combined with a minor amount of a saturated aliphatic dicarboxylic acid or of mixtures thereof, with a diol taken from cyclohexanedimethanol and alkylene glycols wherein the alkylene group has 2 to 6 carbon atoms.

Suitable polyesters are obtained, e.g., by the polycondensation of ethylene glycol with a mixture of phthalic acid and terephthalic acid, the ratio of phthalic acid in the copolyester varying from 40 to 80 mole % and that of terephthalic acid from 60 to 20 mole %. Also suitable are the copolyesters of cyclohexane-dimethanol with phthalic acid and terephthalic acid, the percentage of terephthalic acid being about 20 mole %. Other suitable polyesters are the polycondensation products of cyclohexane-dimethanol with a mixture of terephthalic acid and glutaric acid and the polycondensation products of cyclohexanedimethanol with phthalic acid alone.

In all these polycondensation products the molecular weights are chosen in such a way that the above given requirements of contact-angle, melt viscosity, abrasion resistance and blocking temperature are met. In general the inherent viscosity of the polyesters has to be lower than 0.3 dl/g in case the polyesters are used as such in the formation of the thermo-adhesive layer, otherwise the melt viscosity would be too high. However, if thermo-solvents such as SANTICIZER 1H (trade name) are added to the coating composition for the thermo-adhesive layer in an amount between 10 and 50% by weight of the polyester, the inherent viscosity of the polyester may be much higher, so that the abrasion resistance of the fixing layer will be much higher too.

The inherent viscosity of the polyesters is determined at 25° C at a concentration of 0.5 g of polyester per 100 ml of solution with a 60:40 mixture of phenol and o-dichlorobenzene as solvent.

Equally suitable are unsaturated polyesters obtained by reacting a bis-phenol such as 2,2-bis(4-hydroxyphenyl)-propane(bis-phenol A) with fumaric or maleic anhydride.

According to another embodiment good results are also obtained with homopolymers of benzyl methacrylate, furfuryl methacrylate and alkyl methacrylates and with copolymers of alkyl methacrylates and alkyl acrylates, more especially those polymers with a glass transition temperature higher than 35° C, whereby all these homopolymers and copolymers, possibly together with a thermo-solvent produce polymeric coatings that satisfy the above requirements of blocking temperature and abrasion resistance. It is to be understood that in the copolymers of alkyl methacrylates and alkyl acrylates also minor amounts, e.g. up to 10% by weight, of other monomers may be present, e.g. acrylamide.

In general it is also required that the melt viscosity of the thermo-adhesive fixing layer be at most 100 P when measured at 190° C. However, when homopolymers and copolymers of methacrylates and acrylates are applied as main constituents for the thermo-adhesive fixing layer, those producing fixing layer compositions having melt viscosities below 50 P are preferred because they keep the time necessary to fix the toner particles within practical limits.

From our experiments it has been deduced that homopolymers of alkyl acrylates possessing short-chain alkyl side-substituents are not suitable for the purposes of this invention. Their glass transition temperatures are much too low so that layers produced therewith are not free from blocking below 35° C.

Homopolymers of alkyl methacrylates with short-chain alkyl side-substituents, e.g. polymethyl methacrylate and polyisobutyl methacrylate, possess much higher glass transition temperatures, thus higher blocking temperatures, but also higher melt viscosities. They can only be used for the purpose of the invention when they are mixed with a sufficient quantity of thermo-solvent. In the case of polymethyl methacrylate, however, the quantity of thermo-solvent needed for lowering the melt viscosity below about 50 P at 190° C is so high that the coatings produced from the mixture become unstable. Indeed, for a polymethyl methacrylate having an inherent viscosity of 0.30 dl/g, the amount of SANTICIZER 1H (trade-name) needed is 60 parts by weight for 40 parts by weight of polymer. Upon storage of the layers at room temperature the thermo-solvent is gradually lost by exudation.

Polyethyl methacrylate possibly mixed with a thermo-solvent is suitable for the purposes of the invention. On the contrary higher straight-chain alkyl polymethacrylates such as poly-n-propyl methacrylate and poly-n-butyl methacrylate cannot be used since their glass transition temperatures are too low. They form layers with insufficiently high blocking temperature. In contrast therewith, the homopolymers of branched-chain alkyl methacrylates such as isopropyl, isobutyl, s- and t-butyl methacrylate are suitable, possibly mixed with thermo-solvents, since their glass transition temperatures exceed 35° C.

Particularly good results are obtained with polymers formed from long-chain alkyl acrylates or methacrylates wherein the alkyl groups comprise up to 22 carbon atoms, such as docosyl acrylate or docosyl methacrylate. These long-chain alkyl groups are responsible for the crystalline behaviour of the polymers and copolymers thereof. However, since the homopolymers of these long-chain alkyl acrylates and methacrylates form layers whose abrasion resistance is insufficient, it is preferred to use these long-chain alkyl acrylates and methacrylates in the form of their copolymers with short-chain alkyl methacrylates, such as methyl and ethyl methacrylate, or in the form of their copolymers with short-chain alkyl acrylates wherein the alkyl groups are branched-chain alkyl groups comprising 3 to 6 carbon atoms.

According to another embodiment of the invention the thermoadhesive fixing layer is formed from a copolymer of styrene and allyl alcohol, preferably a copolymer of styrene and allyl alcohol comprising about 80% by weight of styrene.

In another series of experiments it has been established that the addition to the coating composition for the thermoadhesive fixing layer of a small quantity of a wax, e.g. from 1 to 5% by weight calculated on the weight of polymer present, resulted in a considerable increase of the mechanical resistance of the fixing layer against scratching. Suitable waxes are e.g.:

CASTORWAX: trade-name of the Baker Castor Oil Co., USA MONTANWAX

ALBACER: trade-name of Glycol Chemicals, Williamsport, USA

HOECHST WACHSE and CHLORPARAFFIN 40-FLUSSIG, trade-names of Farbwerke Hoechst AG, Frankfurt/M., Western Germany SANTOWAX-P: trade-name of Monsanto Chemical Company, St. Louis, Mo., USA.

Especially with CASTORWAX very good results have been obtained. The addition to the coating composition of the thermo-adhesive fixing layer of 0.1 to 0.5 g of CASTORWAX (trade-name) per 10 g of polymeric binding agent in the layer resulted in a greatly increased abrasion resistance of the layer. The blocking temperature was considerably increased and the fixing time was markedly shortened.

The support for the thermo-adhesive fixing layer is preferably a smooth, non-porous sheet or web material, which — if transparent — may be made e.g. of cellulose nitrate, cellulose ester, e.g. cellulose triacetate, cellulose acetate-butyrate, polyvinylacetal, polystyrene, polymethacrylic acid esters, polysulfones, polycarbonates, or highly polymeric linear polyesters, e.g. polyethylene terephthalate. For special purposes sheets of paper, e.g. of glassine paper, may also be used as support for the thermo-adhesive fixing layer.

The above named film supports being highly transparent for visible light allow the inspection of the toner image with light projected through the image-containing material e.g. on a light-table or in a transparency projector (slide projector).

The polyethylene terephthalate film supports are preferred because of their resistance to moisture and heat and their high mechanical strength obtained after biaxial orientation and heat-setting of the film. Although the thermo-adhesive layer may be applied directly to the support, particularly strong adherence of the thermo-adhesive layer to the resin support is obtained when the hydrophobic resin support, preferably a polyethylene terephthalate support, is subbed with a layer directly adhering to the said hydrophobic film support and substantially consisting of a copolymer formed from 45 to 99.5% by weight of at least one of the chlorine-containing monomers vinylidene chloride and vinyl cloride, from 0.5 to 10% by weight of at least one ethylenically unsaturated hydrophilic monomer, and from 0 to 54.5% by weight of at least one other copolymerisable ethylenically unsaturated monomer.

The vinylidene chloride copolymer may be formed from vinylidene chloride and/or vinyl chloride and hydrophilic monomeric units alone in the ratio indicated above, but up to 54.5% by weight of other recurring units, e.g. acrylamides, methacrylamides, acrylic acid esters, methacrylic acid esters, maleic esters and/or N-alkylmaleimides, may also be present.

The preparation of said vinylidene chloride copolymers suited for said subbing layer is described, e.g., in the United Kingdom patent specification No. 1,234,755 filed Sept. 28, 1967 by the Applicant.

Electrostatically chargeable materials for use in various electrostatographic recording techniques are provided on the rear-side with an electroconductive coating.

According to an embodiment in the toner fixing process of the present invention a toner image receptor material is used, which at the side opposite to the fixing layer contains an antistatic layer applied from an aqueous coating composition.

Preferred recording materials according to the present invention for use in an ionographic imaging chamber as described in the U.S. Pat. No. 3,859,529 of Andrew P. Proudian, Teodoro Azzarelli and Murray Samuel Welkomsky issued Jan. 7, 1975 contain at their rear-side a coating having a surface resistance of at least $10^9$ Ohms/sq. during the formation of the electrostatic image and which can be lowered preferably below $10^6$ Ohms/sq during electrophoretic development. Suitable rear-side coatings for that purpose are photoconductive layers whose surface resistance can be lowered by exposure to ultraviolet radiation and/or visible light.

Other suitable rear-side coatings have such composition that their surface resistance can be lowered by moistening with water.

When the support is a film of polyethylene terephthalate use may be made of the method described in our Belgian patent specification No. 828,369 filed Apr. 25, 1975 by the Applicant. Herein an antistatic layer is applied from an aqueous coating composition on an unstretched or only monoaxially stretched polyester film support. Thereafter the antistatic layer is dried and the film is stretched biaxially or in a direction perpendicular to that of the first stretching operation, followed by heat-setting. The aqueous composition comprises 30 to 80% by weight of an electroconductive product, 10 to 40% of a stretch-improving agent and 10 to 40% of an inert filler material. The electroconductive product may be a polymeric material such as polystyrene sulphonic acid or a low molecular weight antistatic compound such as stearamidopropyl dimethyl-β-hydroxyethyl ammonium nitrate. Most suitable as stretch-improving agents are aliphatic polyhydroxy compounds and as filler material are suitable e.g. polyethylene and amorphous silicon dioxide obtained by the hydrolysis in situ of silane compounds.

All commercially available toners can be used, the only restriction being that the contact-angle between molten thermoadhesive fixing layer composition and toner particles is smaller than 90°.

The toner particles are preferably of the "wet" electrophoretic type incorporating a resin or resin mixture.

The preparation and composition of such toner particles suitable for use in electrophoretic development and fixing according to the present invention is described, e.g., in the United Kingdom Pat. Nos. 1,151,141 filed Feb. 4, 1966 by Gevaert-Agfa N.V. and 1,312,776 filed July 25, 1969 by the Applicant, in the Belgian patent specification No. 825,601 filed Feb. 17, 1975 by the Applicant corresponding with the German patent application No. 2,502,933 filed Jan. 24, 1975 by Agfa-Gevaert AG and in the published German patent application Nos. (DOS) P 2,334,353 filed July 6, 1973 by Agfa-Gevaert AG and P 2,333,850 filed July 3, 1973 by Agfa-Gevaert AG. Normally the electrophoretic developer material consists essentially of finely divided resin-coated pigment (toner) particles dispersed in an insulating liquid having a dielectric constant of not more than 3.

Particularly useful materials for electrophoretic development and fixing according to the present invention contain a polymer essentially consisting of methacrylic acid esters, and most conveniently polymers of acrylic or methacrylic acid esters of hydrogenated abietyl alcohol as described in United Kingdom patent application No. 8689/74 corresponding with German patent application No. 2,502,933 mentioned hereinbefore. The pigment or colouring agent contained in the toner particles may be any of the pigments or dyestuffs commonly employed for that purpose.

Useful toners for electrophoretic development are also described in our United Kingdom patent application No. 38,068/75 filed Sept. 16, 1975 by the Applicant titled "Improved electrophoretic developer".

The way in which the toner image is developed on the thermo-adhesive layer is in no way critical. This can be done by transfer from a photoconductive plate or drum (indirect electrophotography) or by a process wherein the latent image is directly recorded on the thermo-adhesive layer as by ionography as described in U.S. Pat. No. 3,774,029 mentioned hereinbefore.

The thermo-adhesive fixing layer may be heated in different ways, e.g. by convection heat or infrared irradiation. Depending on the heating energy supplied during the fixing step and the constitution of the thermo-adhesive layer, the total fixing time will vary between 5 and 20 s, where e.g. at least 3 s are needed to melt the thermo-adhesive layer and at least 2 s to embed the toner particles that are deposited in an optical density range from 0.2 to 3. Of course, the actual duration of the fixing will largely depend upon the melt viscosity of the molten fixing layer. This melt viscosity has to be lower than 100 P at 190° C, but for some polymers, as is the case with the polymers of alkyl methacrylates mentioned above, it is preferable that the melt viscosity be much smaller and even be lower than 50 P at 190° C in order to keep the fixing time within acceptable limits.

In a very interesting fixing process melting of the thermo-adhesive fixing layer is achieved in the toner image areas merely by flash-heating the light-absorbing toner image and corresponding fixing layer parts by means of an electronic flash unit providing a light energy of 1 to 2.5 W.s/sq.cm for a flash duration of 0.5 to $10.10^{-3}$ s. A suitable electronic flash unit has been described in our United Kingdom patent application No. 38,069/75 filed Sept. 16, 1975 by the Applicant, titled "Fixing of toner images".

The present invention is illustrated by the following examples without, however, limiting it thereto.

EXAMPLE 1

A polyethylene terephthalate film of 0.8 mm thickness was stretched longitudinally 3.5 times the original length and thereafter a subbing layer was applied thereto at a coverage of 50 mg/sq.m from a latex containing 5% by weight of the copolymer of vinylidene chloride, vinyl chloride, n-butyl acrylate and itaconic acid (30:50:18:2% by weight). The rear-side of the polyethylene terephthalate film support was coated with an electroconductive layer from the following coating composition in a ratio of 70 sq.m/l:

| | | |
|---|---|---|
| polystyrene sulphonic acid as a 10% aqueous solution adjusted to pH 8.5 with ammonium hydroxide | 500 | ml |
| diethylene glycol monoethyl ether | 15 | ml |
| SILANE Y-4087 (trade name) | 25 | ml |
| 10% aqueous solution of ULTRAVON W (trade name) | 5 | ml |
| water to make 1000 ml. | | |

SILANE Y-4087 is the trade name of Union Carbide Corp., New York, N.Y., U.S.A. for a silane compound of the formula:

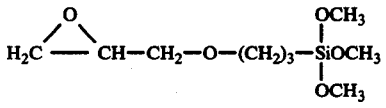

ULTRAVON W is the trade name of CIBA-GEIGY AG, Basle, Switzerland, for a dispersing agent consisting of the disodium salt of heptadecyl benzimidazole disulphonic acid.

Thereafter the film was stretched transversely to about 3.5 times the original width and heat-set by heating at a temperature of 200° C for about 10 seconds while kept under tension.

10 g of a polyester obtained by the polycondensation of cyclohexane dimethanol with a mixture of phthalic acid and terephthalic acid (80:20) having a glass transition temperature of 60° C and an inherent viscosity of 0.22 dl/g were dissolved in a mixture of 75 ml of dichloromethane and 25 ml of dichloroethane. This solution was coated on the above subbing layer such that after drying a layer of about 5 μm thick was obtained. The melt viscosity of the thus formed thermo-adhesive layer at 190° C was 98 P. The surface resistance of the thermo-adhesive fixing layer was above $10^{13}$ Ohm/square.

The sandwich formed was charged electrostatically at the side of the thermo-adhesive fixing layer with a negative corona whose ion stream was directed through image-wise distributed apertures in a copper plate while the electroconductive layer on the rear-side of the film was held in contact with the ground during the charging operation. The corona charge was of such an intensity that the average voltage of the charge applied to the subbed layer was 1000 V negative.

Manufacture of the liquid electrophoretic toner : 180 g of the methacrylic acid ester of hydrogenated abietyl alcohol, 20 g of divinyl benzene, and 100 g of magenta pigment FANALROSA B SUPRA PULVER (trade-name of BASF) were introduced in a kneading apparatus of MEILI, Switzerland, type Liliput 030 L.N. The kneading apparatus was heated with circulating oil at 110° C, so that the temperature of the kneaded mass reached 80°-90° C. Over the kneaded mass nitrogen gas was blown. As soon as a homogeneous mass was obtained having the above indicated temperature of 80°-90° C, 1.8 g of azodiisobutyronitrile were added. Kneading was continued for 2 h while nitrogen was blown continuously over the reaction mass. After about 30 min the mass became more and more viscous.

After kneading for 2 h a tough, viscous mass was formed. Another 1.8 g of azodiisobutyronitrile were added and kneading was continued for 4 h under nitrogen and thereafter for 2 h without nitrogen. The kneaded mass was cooled overnight, broken, and ground in a grinding apparatus I.K.A. model A10 (of Janke & Kunkel, W. Germany) so as to obtain a fine power of resin-precoated magenta pigment. The sticking temperature of the powder on a Kofler hot bench was about 220° C. The solubility of the resin-precoated polymer in ISOPAR G (trade-name) was 28%, which means that 28% by weight of copolymer are dissolved with respect to the total weight of monomers present in a 4 w/vol % solution.

The following products were introduced in a ball-mill:

10 g of 30% by weight of NEOCRYL B702 (trade-name) in ISOPAR G (trade-name)

2 g of the above prepared resin-precoated pigment.

Exactly 1 ml of a 0.2% solution of zinc mono-(2-butyloctyl) phosphate in ISOPAR G (trade-name) was also added to this mixture.

ISOPAR G (trade-name) was now added to make a total volume of 50 ml, and the whole was milled for 15 h.

To form the liquid electrophoretic toner 10 ml of the thus milled solution were added to 1 l of ISOPAR G (trade-name).

The charge pattern produced on the above formed sandwich was developed with this liquid electrophoretic toner to a transmission density of 3.

The sandwich was then placed in a convection oven heated at 120° C. The contact-angle of the molten thermo-adhesive fixing layer with the toner particles was 45°. Fixing occurred within 20 s. The fixed image had a blocking temperature of 40° C and an abrasion resistance of 175 g. The fixed toner images were excellent.

When in the thermo-adhesive fixing layer in the above Example the thermoplastic copolyester having an inherent viscosity of 0.22 dl/g was replaced by a same copolyester having an inherent viscosity of 0.30 dl/g, i.e. a polyester of much higher molecular weight, the melt viscosity measured at 190° C of the thermo-adhesive fixing layer was increased to 200 P, so that the fixing of the toner image could not occur within 20 s.

The use of a same copolyester having, however, an inherent viscosity of only 0.15 dl/g was also unsuitable. Although fixing occurred within the 20 s limit, the abrasion resistance of the fixed image was only 125 g, which was insufficient.

EXAMPLE 2

The process of Example 1 was repeated after the copolyester for the thermo-adhesive fixing layer had been replaced by comparable copolyesters of cyclohexane dimethanol and 80:20 mixtures of phthalic acid and terephthalic acid, but of varying inherent viscosities. Contrary to Example 1 there was added as thermo-solvent to the coating composition of the thermo-adhesive layers 10% by weight of SANTICIZER 1H (trade-name) with respect to the weight of copolyester present.

The results are given in the following table.

| test | inherent viscosity of copolyester dl/g | melt viscosity P at 190° C | fixing within 20 s | abrasion resistance g | blocking temperature ° C |
|---|---|---|---|---|---|
| 1 | 0.30 | 100 | good | 225 | 45° |
| 2 | 0.26 | 90 | good | 200 | 45° |
| 3 | 0.15 | 40 | good | 100 | 35° |

In all 3 tests the contact angle between the melt of the fixing layer and the toner materials was about 45° at equilibrium.

In test no. 1 a copolyester having an inherent viscosity of 0.30 dl/g was used, giving excellent results. In Example 1 a similar copolyester possessing an inherent viscosity of 0.30 dl/g could not be used since the melt viscosity was much too high. In the present case the addition of the thermosolvent reduced the melt viscosity to 100 P so that the fixing time was reduced to exactly 20 s. Good toner images were formed. In the case of test no. 3 the inherent viscosity was only 0.15 dl/g so that the abrasion resistance was reduced to 100 g, which is too low for being used in the invention.

EXAMPLE 3

The process of Example 1 was repeated. The copolyester used for the coating of the thermo-adhesive fixing layer was replaced by a same amount of a polyester of cyclohexane dimethanol and phthalic acid having an inherent viscosity of 0.25 dl/g, a melt viscosity of 95 P and a glass transition temperature of 55° C. The thermo-adhesive fixing layer had a surface resistance above $10^{13}$ Ohm/sq. The contact angle of the molten layer with the toner particles is 48° at equilibrium.

The toner image was fixed within 20 s, the fixed layer has a blocking temperature of 40° C and the abrasion resistance was 225 g. Good fixed toner images were obtained.

When the above polyethylene phthalate was replaced by a similar polyester but having an inherent viscosity above 0.3 dl/g, the toner image could not be fixed as quickly. On the other hand, by using a same polyester having an inherent viscosity of only 0.19 dl/g fixing speed was good, but the abrasion resistance was only 150 g, thus too low.

EXAMPLE 4

The process of Example 1 was repeated but for the thermo-adhesive fixing layer a polyester of cyclohexane dimethanol and isophthalic acid having an inherent viscosity of 0.29 dl/g was used. This polyester was mixed with 10% by weight of SANTICIZER 1H (trade-name). The surface resistance of the fixing layer was above $10^{13}$ Ohm/square.

The toner image was fixed within 20 s, the contact-angle of the molten fixing layer was about 50°, its melt viscosity below 100 P, the blocking temperature of the layer was 40° C and its abrasion resistance was 190 g, giving good fixed toner images.

EXAMPLE 5

A series of polyesters were formed by the polycondensation of ethylene glycol with varying mixtures of phthalic acid and terephthalic acid and the different polyesters formed were used for the formation of thermo-adhesive layers as described in Example 1. Further the process of Example 1 was repeated for fixing the toner images. The following results were obtained:

| test no. | mixture of diacids: phthalic acid % | mixture of diacids: terephthalic acid % | viscosity dl/g | Tg ° C | melt visc. in P | fixing within 20 s | Abrasion resistance g | blocking temp. ° C |
|---|---|---|---|---|---|---|---|---|
| 4 | 80 | 20 | 0.29 | 39.5 | 65 | good | 275 | 40–45 |
| 5 | 70 | 30 | 0.25 | 41 | 40 | good | 250 | 40 |
| 6 | 60 | 40 | 0.27 | 44 | 85 | good | 250 | 45 |
| 7 | 40 | 60 | 0.22 | 41.5 | 44 | good | 225 | 40 |

In all these tests the surface resistance of the fixing layer was above $10^{13}$ Ohm/sq and the contact-angle of the fixing layer melt with the toner particles was about 25°.

When in test no. 4 the polyester was replaced by a comparable polyester of same constitution but having an inherent viscosity of 0.44 dl/g fixing did not occur within 20 s. Upon using, however, a polyester of much lower inherent viscosity, say 0.10 dl/g. the abrasion resistance became too low.

EXAMPLE 6

The process of Example 1 was repeated, however, after the polyester used in the formation of the thermo-adhesive fixing layer had been replaced by a same amount of a copolymer of methyl methacrylate and lauryl methacrylate (70:30% by weight).

When this copolymer was used as such, thus without the addition of a thermo-solvent, the melt viscosity of the thermo-adhesive fixing layer measured at 190° C amounted to 265 P, which makes this copolymer unsuitable for the purposes of the invention.

However, the addition to the coating composition for the thermo-adhesive fixing layer of 10% by weight of SANTICIZER 1H (trade-name) with respect to the weight of copolymer reduced the melt viscosity of the fixing layer to 34 P. The surface resistance of the thermo-adhesive fixing layer was above $10^{13}$ Ohm/sq and the contact-angle of the molten layer with the toner particles was about 50°. Fixing occurred within 20 s, the blocking temperature of the fixing layer was 40° C and its abrasion resistance 175 g, so that excellent toner images could be fixed.

EXAMPLE 7

The process of Example 1 was repeated with the difference that the polyester used in the forming of the thermo-adhesive fixing layer was replaced by the same amount of a copolymer of methyl methacrylate and docosyl methacrylate (40:60% by weight). The surface resistance of the fixing layer was above $10^{13}$ Ohm/sq. The melt viscosity at 190° C of the fixing layer was 30 P. The toner image could be fixed within 20 s, the blocking temperature of the fixing layer was above 35° C, the contact-angle of the molten layer with the toner particles was 55° and the abrasion resistance of the fixed image was 175 g.

When in the above copolymer the amount of methyl methacrylate was increased to 50% by weight so that only 50% of docosyl methacrylate were present, fixing of the toner image could not occur within 20 s.

EXAMPLE 8

The process of Example 1 was repeated with the difference that the polyester used in the formation of the thermo-adhesive fixing layer was replaced by a same amount of the copolymer of methyl methacrylate, docosyl methacrylate and acryl amide (43:51:6% by weight). Surface resistance of the thermo-adhesive fixing layer was larger than $10^{13}$ Ohm/sq and the contact-angle of the molten layer with the toner particles was smaller than 90°.

The melt viscosity at 190° C of the fixing layer was 29 P. Fixing of the toner image occurred within 20 s, the blocking temperature of the fixing layer was above 35° C and the abrasion resistance of the fixed layer was 200 g. Good fixed toner images were obtained.

When the above copolymer was replaced by a copolymer of methyl methacrylate, docosyl methacrylate and acrylamide (35:55:10% by weight) the data became as follows:

melt viscosity at 190° C : 48 P
fixing time : also within 20 s
blocking temperature : above 35° C
abrasion resistance : 300 g With this copolymer also good fixed toner images were obtained.

EXAMPLE 9

The process of Example 1 was repeated. However, to the coating composition for the thermo-adhesive fixing layer containing the copolyester of cyclohexane dimethanol and a 80:20 mixture of phthalic acid and terephthalic acid, were added 1 g of SANTICIZER 1H (trade-name) and 0.1 g of different waxes, both amounts being calculated per 10 g of copolyester present.

The blocking temperature of the fixing layer and the abrasion resistance of the fixed toner image, depending on the wax used, were as follows:

| test no. | wax | abrasion resistance g | blocking temperature ° C |
|---|---|---|---|
| 1 | CASTORWAX | 250 g | above 35° |
| 2 | MONTANWAX | 200 g | above 35° |
| 3 | ALBACER | 200 g | above 35° |
| 4 | Hoechst Wachse | 200 g | above 35° |

EXAMPLE 10

To a sheet of glassine paper a thermo-adhesive fixing layer was applied from the polyester of cyclohexane dimethanol and phthalic acid described in Example 3, in such a manner that after drying a layer of 50 μm thick was formed.

The thus obtained sandwich was electrostatically charged as described in Example 1 and the charge pattern was developed with a dry toner-carrier combination using the cascade method.

The toner was obtained by milling the following mixture:

10% by weight of carbon black
65–70% by weight of the copolymer of styrene and n-butylmethacrylate (65:35% by weight)
10–20% by weight of polyvinylbutyral.

As carrier were used iron particles coated with a polyvinylformaldehyde resin.

The sandwich carrying the toner image was thereafter placed in a convection oven heated at 100° C. Fixing occurred within 20 seconds, producing excellent toner images. If the paper support had not been coated with a thermo-adhesive fixing layer, it would have been necessary to heat the sandwich at 150° C for fixing the toner image within the same period of time.

EXAMPLE 11

6 g of a copolymer of styrene and allyl alcohol comprising 80% by weight of styrene were dissolved in a 75:25 mixture of methylene chloride and dichloroethane and 4 ml of a 10% (g/vol.) solution of CASTORWAX in chloroform were added thereto. The mixture of methylene chloride and dichloroethane was added until the total volume of solution was 100 ml.

A polyethylene terephthalate film provided with a subbing layer from a latex of a copolymer of vinylidene chloride, vinyl chloride, n-butyl acrylate, and itaconic acid (30:50:18:2% by weight), and which had been stretched biaxially as described in Example 1, was covered with a layer from the above formed solution, in such a way that after drying a layer of about 5 μm was obtained. The surface resistance of this layer was above $10^{13}$ Ohm/square whereas the melt viscosity at 150° C was 65 P so that at 190° C it was surely below 100 P.

After image-wise charging electrostatically as described in Example 1, the image was developed with the liquid electrophoretic toner to a transmission density of 3, and fixed at 120° C for 15 s. The toner image was completely fixed and the properties of the image were as follows:

abrasion resistance, 175 g
blocking temperature, > 35° C

EXAMPLE 12

The process of Example 7 was repeated with the difference that the copolymer of methyl methacrylate and docosyl methacrylate used in said Example for the formation of the thermo-adhesive layer, was replaced by a same amount of the copolymer of methyl methacrylate and docosyl acrylate (45:55% by weight) having an inherent viscosity of 0.21 dl/g when measured at 25° C in butanone.

The surface resistance of the fixing layer was above $10^{13}$ Ohm/sq. The melt viscosity at 190° C of the fixing layer was 25 P. The toner image could be fixed within 20 s, the blocking temperature of the fixing layer was above 35° C, the contact angle of the molten layer with the toner particles was 55° and the abrasion resistance of the fixed image was 100 g.

We claim:

1. A process for electrophoretically depositing and fixing an electrophoretic toner particle image on a sheet or web material comprising a support and permanently adhered to said support a fixing layer of a thermo-adhesive defining the surface of said material on which said toner image particles are deposited, said process comprising the steps of passing said material with an electrostatic charge pattern carried in said thermo-adhesive fixing layer through an electrophoretic developing liquid comprising finely divided resin-coated pigment particles suspended in an insulating carrier liquid to imagewise deposit said particles on said fixing layer, said resin-coated particles being adapted to form with said thermo-adhesive when the latter is in melted condition a contact angle smaller than 90° so that said particles will be wet by molten thermo-adhesive and heating for a time not longer than about 20 seconds to a temperature which is above 90° C at least those parts of such layer corresponding with the toner image but below a temperature at which permanent deformation of the sheet or web material occurs, said heating being of a sufficient intensity as to melt said thermo-adhesive and maintain the same melted until said particles sink into embedded relation within the melted fixing layer in the absence of applied mechanical pressure, and allowing said imaged layer to cool and solidify with said image particles embedded in said layer, said thermo-adhesive fixing layer comprising an organic polymeric material, having a surface resistance above $10^{10}$ Ohm/square, freedom from blocking at least up to 35° C, a melt viscosity at 190° C of not more than 120 P and an abrasion resistance at 20° C above 175 g, said blocking, abrasion resistance, melt viscosity and contact angle values being determined according to the respective "standard tests" described in the specification.

2. A process according to claim 1, wherein said thermo-adhesive fixing layer has a thickness between 3 and 10 μm.

3. A process according to claim 1, wherein said organic polymer material is a linear polyester of (a) at least one dicarboxylic acid taken from the group consisting of terephthalic acid, isophthalic acid, phthalic acid, at least one of said dicarboxylic acids combined with a minor amount of a saturated aliphatic dicarboxylic acid and mixtures thereof and (b) a diol taken from the group consisting of cyclohexane dimethanol and alkylene glycols, wherein the alkylene group has 2 to 6 carbon atoms.

4. A process according to claim 3, wherein the linear polyester is (a) a polycondensation product of ethylene glycol with a mixture of phthalic acid and terephthalic acid, the ratio of phthalic acid in said mixture varying from 40 to 80 mole % and that of terephthalic acid from 60 to 20 mole %, or (b) a polycondensation product of cyclohexane dimethanol with a mixture of phthalic acid and terephthalic acid comprising 20 mole % of terephthalic acid.

5. A process according to claim 1, wherein said organic polymeric material is a homopolymer of benzyl methacrylate, furfuryl methacrylate, or an alkyl methacrylate, or a copolymer of an alkyl methacrylate and an alkyl acrylate, said homopolymers and copolymers possessing glass transition temperatures above 35° C.

6. A process according to claim 1, wherein said organic polymeric material is a copolymer of methyl methacrylate and lauryl methacrylate (70:30% by weight), a copolymer of methyl methacrylate and docosyl methacrylate (40:60% by weight), or a copolymer of methyl methacrylate, docosyl methacrylate, and acrylamide (43:51:6% by weight).

7. A process according to claim 1, wherein said organic polymer material is a copolymer of styrene and allyl alcohol (80:20% by weight).

8. A process according to claim 1, wherein a thermo-solvent in an amount of 10 to 50% by weight with respect to the weight of organic polymeric material is present in the coating composition for said thermo-adhesive fixing layer.

9. A process according to claim 1, wherein a wax in an amount of 1 to 5% by weight calculated on the weight of organic polymeric material is present in the coating composition for said thermo-adhesive fixing layer.

10. A process according to claim 1, wherein said support is a smooth, transparent, biaxially oriented polyethylene terephthalate film.

11. A process according to claim 10, wherein between said polyethylene terephthalate film support and said thermo-adhesive fixing layer a subbing layer is present comprising a copolymer of 45 to 99.5% by weight of at least one of the chlorine-containing monomers vinylidene chloride or vinyl chloride, 0.5 to 10% by weight of at least one ethylenically unsaturated hydrophilic monomer and 0 to 54.5% by weight of at least one other copolymerisable ethylenically unsaturated monomer.

12. A process according to claim 11, wherein said subbing layer comprises a copolymer of vinylidene chloride, vinyl chloride, n-butyl acrylate, and itaconic acid (30:50:18:2% by weight).

13. A process according to claim 10, wherein on the side of said smooth transparent film support opposite to the thermo-adhesive fixing layer an electroconductive layer is present.

14. A process according to claim 1, wherein on the side of said support opposite to the thermo-adhesive fixing layer a coating is present having a surface resistance of at least $10^9$ Ohm/square, which can be lowered below $10^6$ Ohm/square by moistening with water.

15. A process according to claim 1, wherein said electrostatic charge pattern is formed on said thermo-adhesive fixing layer through ionography to constitute a latent image suitable for toner development.

* * * * *